US006623004B2

(12) United States Patent
Rossi et al.

(10) Patent No.: US 6,623,004 B2
(45) Date of Patent: Sep. 23, 2003

(54) SOCCER GAME TABLE WITH ROUNDED CORNERS

(75) Inventors: David Rossi, Newton, NJ (US); Michael Nally, Ridgewood, NJ (US); Seth Hochberg, Morristown, NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 0 days.

(21) Appl. No.: 09/780,921

(22) Filed: Feb. 9, 2001

(65) Prior Publication Data

US 2001/0033053 A1 Oct. 25, 2001

Related U.S. Application Data

(60) Provisional application No. 60/181,926, filed on Feb. 11, 2000.

(51) Int. Cl.[7] ..... A63F 7/00

(52) U.S. Cl. ..... 273/108.1; 273/108.52; 273/118 R; 273/119 R

(58) Field of Search ..... 273/108, 108.1, 273/108.5–108.57, 118 R–126 A; D21/313, 314, 318

(56) References Cited

U.S. PATENT DOCUMENTS

| | | | | | |
|---|---|---|---|---|---|
| 1,615,491 | A | * | 1/1927 | Thornton | 273/108.52 |
| 1,934,381 | A | * | 11/1933 | Slosson | 273/108.52 |
| 2,716,028 | A | * | 8/1955 | Yaeger | 273/108.51 |
| 2,819,082 | A | * | 1/1958 | Peter | 273/108.53 |
| 3,112,930 | A | * | 12/1963 | Wertz | 273/108.52 |
| 3,655,113 | A | * | 4/1972 | Carroll | 206/586 |
| 3,870,303 | A | * | 3/1975 | Patterson, Jr. | 273/108.52 |
| 3,926,432 | A | * | 12/1975 | Furr et al. | 273/108.52 |
| 4,025,073 | A | * | 5/1977 | Furr et al. | 273/108.52 |
| 4,046,286 | A | | 9/1977 | Peppard | |
| 4,072,231 | A | * | 2/1978 | Helms | 206/453 |
| 4,148,484 | A | * | 4/1979 | Georgiev et al. | 273/108.55 |
| 4,872,679 | A | * | 10/1989 | Bohaski et al. | 273/108 |
| 4,988,083 | A | * | 1/1991 | Bradley | 267/140 |
| 5,112,047 | A | * | 5/1992 | Monneret | 273/108.52 |
| 5,356,143 | A | * | 10/1994 | Hylak | 273/126 A |
| 5,613,683 | A | | 3/1997 | Ying et al. | |
| 5,630,760 | A | * | 5/1997 | Brown et al. | 273/108.52 |
| 5,639,072 | A | * | 6/1997 | McCall | 267/139 |
| 6,105,961 | A | | 8/2000 | Price | |
| 6,345,820 | B1 | * | 2/2002 | Zucchi et al. | 273/108.5 |
| 2001/0033053 | A1 | * | 10/2001 | Rossi et al. | 273/108.52 |

* cited by examiner

*Primary Examiner*—Raleigh W. Chiu
(74) *Attorney, Agent, or Firm*—Fellers, Snider, Blankenship, Bailey & Tippens, P.C.

(57) ABSTRACT

The present invention provides a soccer game table comprising a game surface; at least four sidewall sections surrounding the game surface; and a corner defined by the intersection of two of the sidewall sections, the corner having a curved face. Another preferred embodiment of the present invention provides a soccer game table comprising a game surface; at least four sidewall sections surrounding the game surface; a substantially right-angled corner defined by the intersection of two of the sidewall sections; and a removable corner member having a curved face, the removable corner member being adapted to convert the substantially right-angled corner to a rounded corner.

13 Claims, 3 Drawing Sheets

SOCCER GAME TABLE WITH ROUNDED CORNERS

CROSS-REFERENCE TO RELATED APPLICATIONS

Priority is claimed from U.S. Provisional Patent Application Ser. No. 60/181,926 filed Feb. 11, 2000 and incorporated by reference herein.

BACKGROUND OF THE INVENTION

1. Field of the Invention

The present invention relates to a soccer game and specifically to a soccer game table having rounded corners, as opposed to right-angled corners.

2. Prior Art

Soccer game tables have been known for many years. In these games, a planar game surface is surrounded by a wall extending above the game surface. With reference to the prior art as generally depicted for purposes of illustration in FIG. 2, the game surface is typically rectangular with four sidewalls that define right-angled corners. Goal openings are provided at the center of each sidewall extending along the short sides of the rectangular game surface.

Player rods extend across the game surface between the sidewalls extending along the long sides of the rectangular game surface. Each player rod extends through a corresponding bore provided in each of the game sidewalls along the long sides of the rectangle. Typically there are a total of eight player rods, four rods for each soccer team although other configurations are possible. The rod closest to the goal represent the goalie. One or more player figures are mounted on each player rod such that the player figures are suspended above the game surface. Each player rod includes a handle used by a game user to both rotate the rod and the player figures mounted thereon, as well as shift the lateral position of the player figures relative to the game surface.

The soccer game may be played by each game user using the player figures on the user's team to advance a game ball past the opponent's player figures and into the opponent's goal.

Due to inherent limitations on the length and reach of the player rods, it may not be possible to reach a game ball located in one of the right-angled corners with the goalie player figures. Thus, the right-angled corners may constitute a "dead spot" on the game surface. Play may be made more interesting by the elimination of these dead spots, or at least by reducing the tendency of the game ball to come to rest in these dead spots.

Accordingly, there is a need for a soccer game table that eliminates dead spots at the corners of the game surface, and/or reduces the tendency of the game ball from resting in these dead spots.

There is also a need for a soccer game table wherein strategic reorienting of the game ball may be accomplished.

SUMMARY OF THE INVENTION

Responsive to the foregoing challenges, Applicants have developed an innovative soccer game table comprising: a game surface; at least four sidewall sections surrounding and extending from said game surface; and a corner defined by the intersection of two of said sidewall sections, said corner having a curved face.

Applicants have also developed an innovative soccer game table comprising: a game surface; at least four sidewall sections surrounding said game surface; a substantially right-angled corner defined by the intersection of two of said sidewall sections; and a removable corner member having a curved face, said removable corner member being adapted to convert said substantially right-angled corner to a rounded corner.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

In this respect, before explaining at least one embodiment of the invention in detail, it is to be understood that the invention is not limited in this application to the details of construction and to the arrangement so the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the design engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefor an object of the present invention to provide a soccer game table that eliminates dead spots in the corners of game table.

It is another object of the present invention to provide a soccer game table with corners that reduce the tendency of the game ball to come to rest in the corners.

It is yet another object of the present invention to provide a soccer game table with corners that make it easier to contact a game ball resting in the corner with a goalie player figure.

It is still yet another object of the present invention to provide a soccer game table that may be converted between having right-angled interior corners and having rounded interior corners.

It is yet another object of the present invention to convert a normally inactive area of a soccer game table into an active area that may be targeted by game users to set up scoring attempts.

Additional objects and advantages of the invention are set forth, in part, in the description which follows and, in part, will be apparent to one of ordinary skill in the art from the description and/or from the practice of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings, depictions and descriptive matter in which there is illustrated preferred embodiments and results of the invention.

DETAILED DESCRIPTION OF THE PREFERRED EMBODIMENTS

Figure 1:
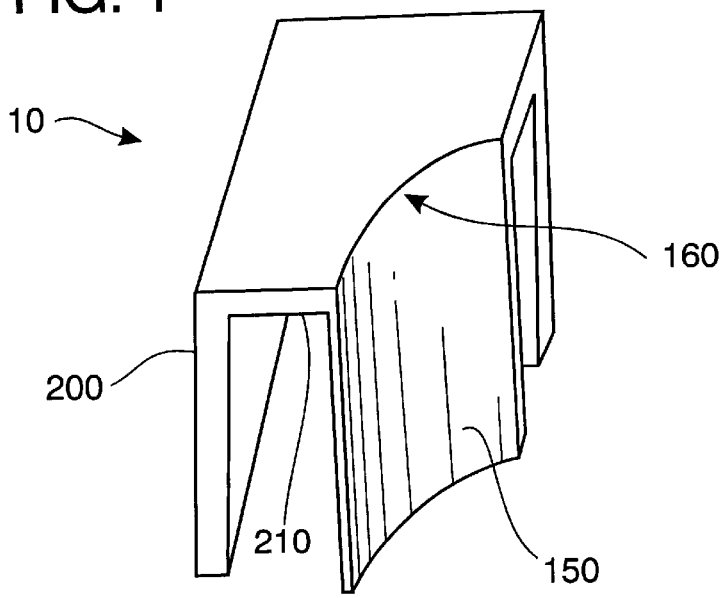
FIG. 1 is a perspective view of a preferred embodiment of an adaptable corner member for converting right-angled interior corners of prior art soccer game tables.

Referring to the drawings in detail where like reference characters refer to like elements in the other drawing figures and referring to FIG. 1 in particular, reference character 10 generally designates a new and improved rounded corner member for soccer game tables constructed in accordance with a preferred embodiment of the invention.

Figure 2:
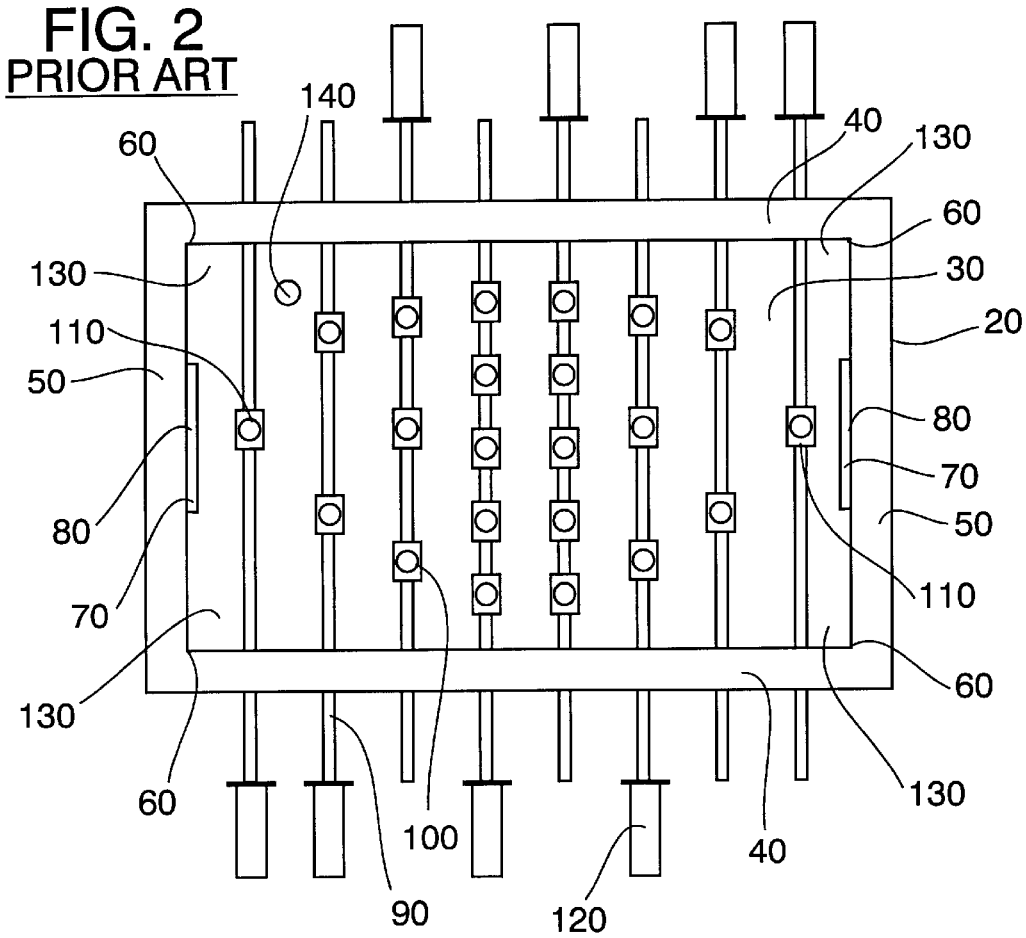
FIG. 2 PRIOR ART
FIG. 2 is a top plan view of a prior art soccer game table having right-angled interior corners.

With reference to FIG. 2 in particular, the prior art soccer game table 20 generally include a game surface 30 that is typically rectangular with four upstanding sidewalls that retain the game ball in play. There are generally parallel longer sidewalls 40 and generally parallel shorter end walls 50 that define right-angled corners 60. Opposed goal openings 70 are provided at the center 80 of each shorter end sidewall 50 of the rectangular game surface 30.

Player rods 90 extend across the game surface 30 between and generally parallel with the shorter end sidewalls 50. Each player rod 90 extends through a corresponding bore 95 provided in each of the longer sidewalls 40. Typically there are a total of eight player rods 90, four rods 90 for each soccer team. One or more player figures 100 are mounted on each player rod 90 such that the player figures 100 are suspended above the game surface 30. Typically, the player figure 100 closest in proximity to the respective goal openings 70 are generally referred to as goal keepers or goalies 110. The player rods 90 each include a handle 120 used by a game user to both rotate the rod 90 axially and the respective player figures 100 mounted thereon, as well as shift the lateral position of the player figures 100 (move the rod axially) relative to the game surface 30.

Zones 130 generally located at or near the right-angled corners 60 where a game ball 140 can not be reached by player figures 100 are generally referred to as "dead spots" on the game surface 30.

Each rounded corner member 10 generally includes an interior curved face 150 that has a radius of curvature 160 adapted to redirect a game ball 140 from rolling along the longer sidewall 40 to rolling along the shorter end sidewalls 50 (and vice versa) and generally eliminating dead spot zones 130. The curved face 150 of the rounded corner member 10 may define a circular, parabolic, hyperbolic, spherical, or other rounded shape curved in two or three dimensions.

Figure 3:
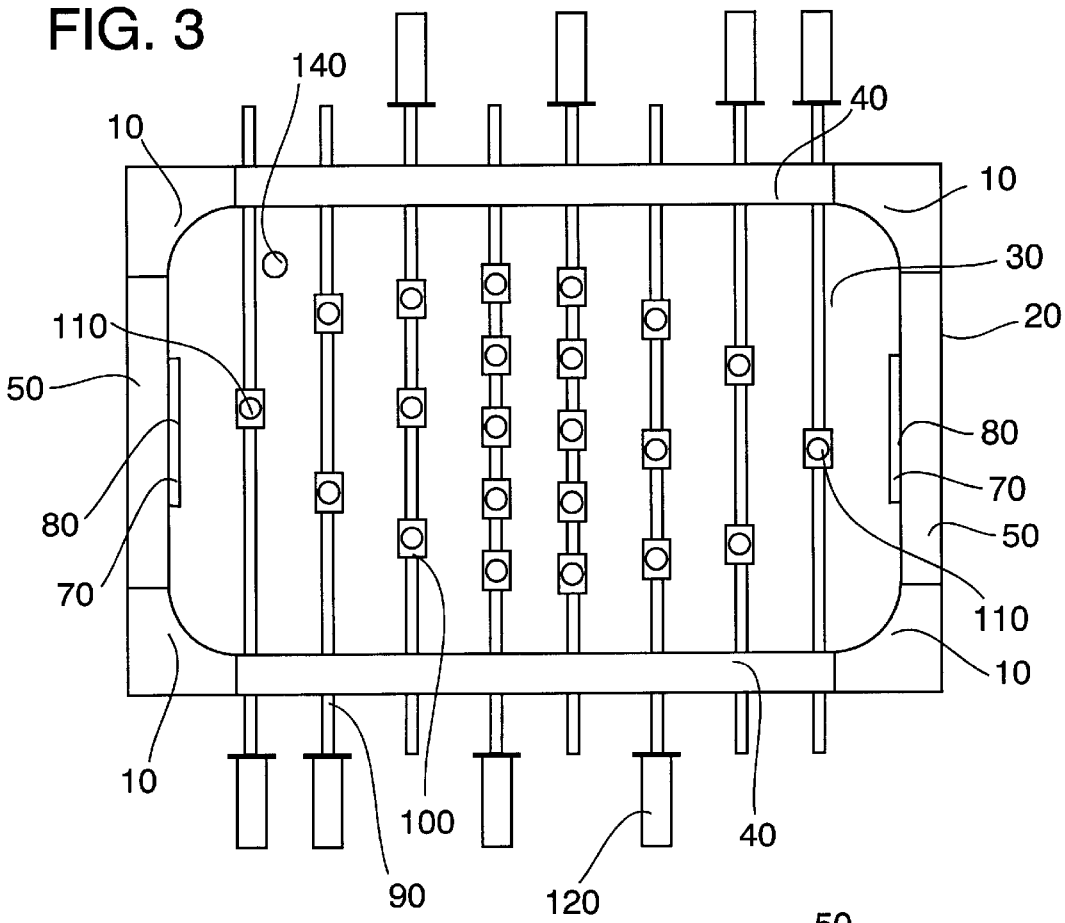
FIG. 3 is atop plan view of a soccer game table having rounded interior corners in accordance with an embodiment of the invention.

Referring to FIG. 3 in detail, it is contemplated that rounded corner members 10 may fit over the right angle corners 60 may be permanently installed on the existing prior art soccer table 20, thus converting the prior existing right angle corners 60 to rounded corner members 10 and eliminating dead spot zones 130.

Figure 4:
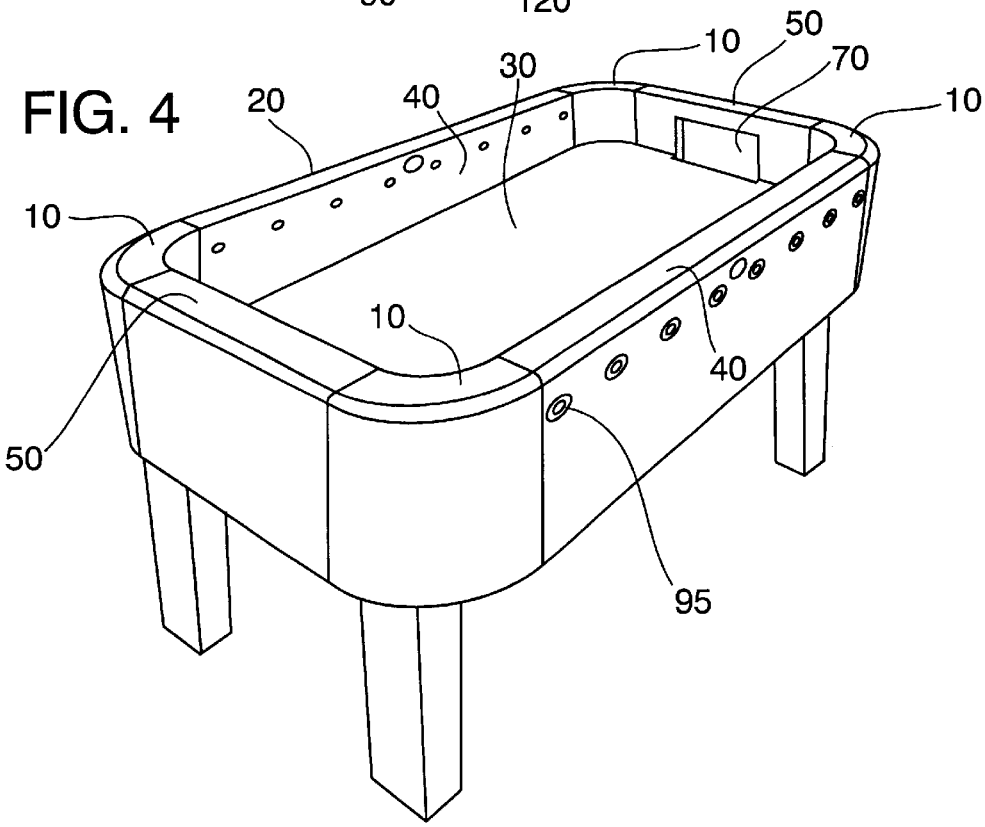
FIG. 4 is a partial pictorial illustration of another preferred embodiment of the invention incorporated into a soccer game table showing rounded interior corners (with rods removed for clarity).

With reference to FIG. 4, it is also contemplated that another preferred embodiment of invention 10 is shown where longer sidewalls 40 and shorter end walls 50, define rounded corner members 10. It is appreciated that the embodiment shown in FIG. 4 includes a plurality of player rods 90 as previously disclosed. The player rods 90 are not shown in FIG. 4 for ease of illustration.

Figure 5:
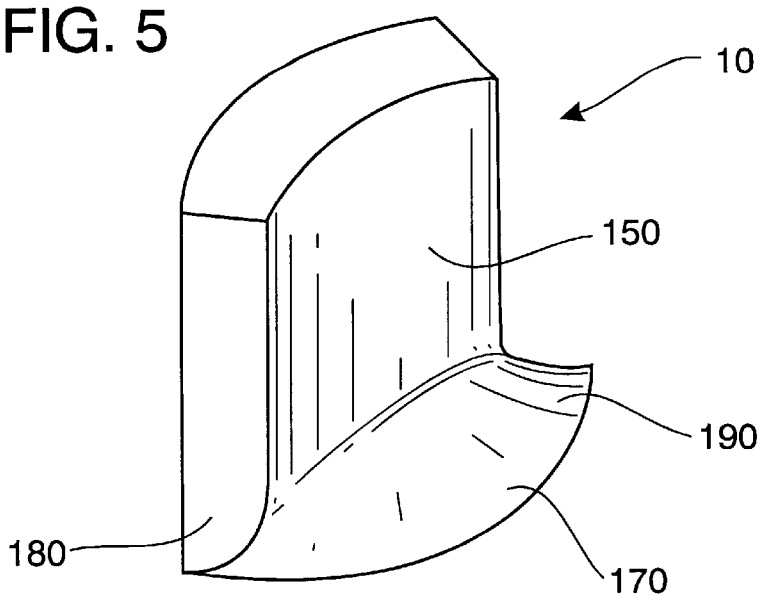
FIG. 5 is a pictorial illustration of a removable member used to convert a soccer game table with right-angled interior corners to a table with rounded interior corners in accordance with another embodiment of the invention.

Referring to FIG. 5 in particular, another preferred embodiment of rounded corner member 10 may include an inclined foot 170 located at the base 180 of the curved face 150. The inclined foot 170 may provide a gently upward sloping surface 190 from the game surface 30 to the curved face 150. The inclined foot 170 will provide a surface on which the game ball will move.

Returning to a consideration of FIG. 1, it is also contemplated rounded corner members 10 may further be adapted to be removably installed in existing prior art soccer table 20. A preferred embodiment of rounded corner member 10 may further include a mounting bracket 200 which generally fits over right angle corners 60 and allows the rounded corner member 10 to removably slide on and off the prior art soccer game table 20. Bracket 200 may further include leg member 210 which may be adjustable to fit over different sized prior art soccer table games 20 substantially right angled corners 60.

Figure 6:
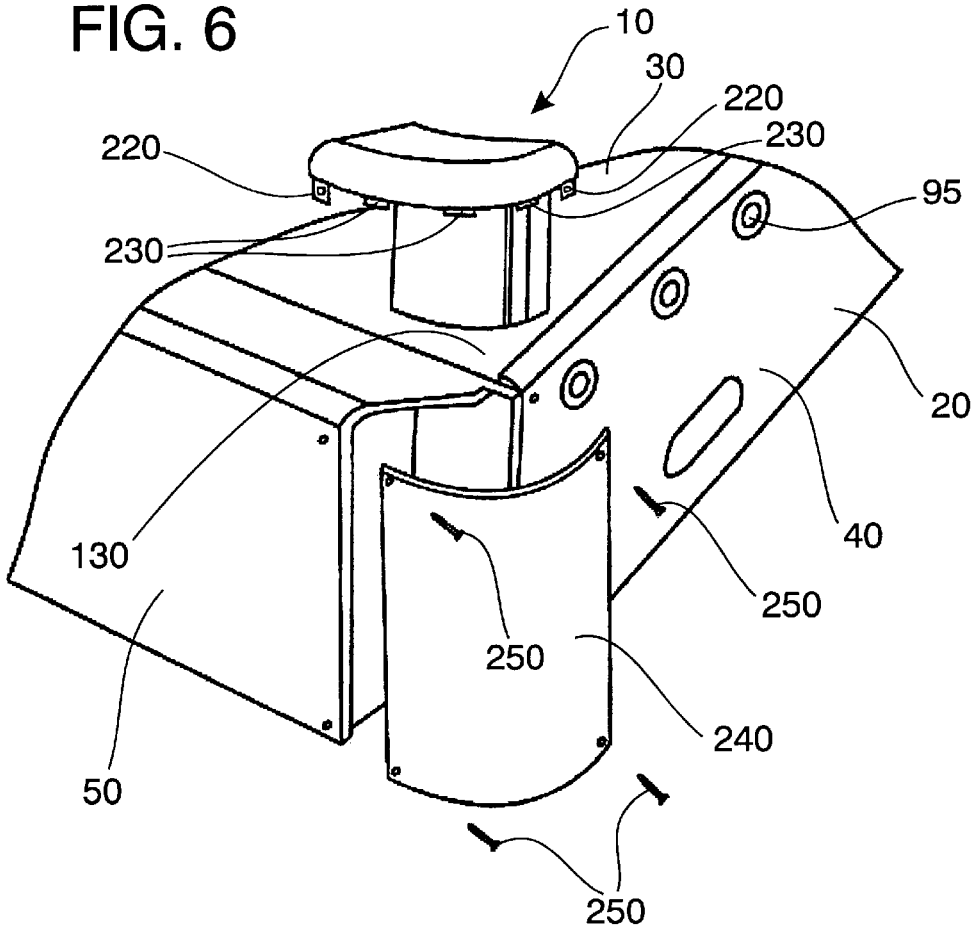
FIG. 6 is a pictorial illustration of another removable member used to provide a soccer game table with rounded interior corners in accordance with yet another embodiment of the invention.

Referring to FIG. 6 in detail, another preferred embodiment of rounded corner members 10 is generally shown with extending screw tabs 220 for attaching invention 10 to soccer game table 20. It is also contemplated that extending snap-on tabs 230 may also be included. It is still further contemplated that cover 240 may be attached to soccer game table 20 by screws 250 or other such suitable attachment means.

It will be apparent to those skilled in the art that various modifications and variations can be made in the construction, configuration, and/or operation of the present invention without departing from the scope or spirit of the invention. For example, in the embodiments mentioned above, variations in the materials used to make each element of the invention may vary without departing from the scope of the invention. Furthermore, it is contemplated that the means used to form a rounded corner may be temporary or permanent, and if temporary, may include any method of temporarily attaching a rounded corner member (e.g. clamps, magnets, adhesives, slots, etc.) without departing from the scope of the invention. Thus, it is intended that the present invention cover the modifications and variations of the invention provided they come within the scope of the appended claims and their equivalents.

In summary, the present invention provides a soccer game table comprising a game surface; at least four sidewall sections surrounding said game surface; and a corner defined by the intersection of two of said sidewall sections, said corner having a curved face.

The present invention also provides a soccer game table wherein said curved face has a circular radius of curvature.

The present invention further provides a soccer game table wherein said curved face has a parabolic radius of curvature.

The present invention still further provides a soccer game table wherein said curved face has a hyperbolic radius of curvature.

The present invention yet still further provides a soccer game table wherein said curved face is curved in three dimensions.

The present invention provides a soccer game table wherein said curved face includes a portion having a spherical radius of curvature.

The present invention also provides a soccer game table wherein said corner includes an inclined foot.

The present invention further provides a soccer game table further comprising a game ball adapted to roll on the game surface, wherein said sidewall sections include a longitudinal sidewall section and an end sidewall section, and wherein said curved face has a radius of curvature adapted to redirect game ball roll along the longitudinal sidewall to roll along the end sidewall.

Another preferred embodiment of the present invention provides a soccer game table comprising a game surface; at least four sidewall sections surrounding said game surface; a substantially right-angled corner defined by the intersection of two of said sidewall sections; and a removable corner member having a curved face, said removable corner member being adapted to convert said substantially right-angled corner to a rounded corner.

The aforementioned embodiment of the present invention also provides a soccer game table wherein said curved face has a circular radius of curvature.

The aforementioned embodiment of the present invention further provides a soccer game table wherein said curved face has a parabolic radius of curvature.

The aforementioned embodiment of the present invention still further provides a soccer game table wherein said curved face has a hyperbolic radius of curvature.

The aforementioned embodiment of the present invention yet still further provides a soccer game table wherein said curved face is curved in three dimensions.

The aforementioned embodiment of the present invention provides a soccer game table wherein said curved face includes a portion having a substantially spherical radius of curvature.

The aforementioned embodiment of the present invention also provides a soccer game table wherein said corner includes an inclined foot.

The aforementioned embodiment of the present invention still also provides a soccer game table further comprising a game ball adapted to roll on the game surface, wherein said sidewall sections include a longitudinal sidewall section and an end sidewall section, and wherein said curved face has a radius of curvature adapted to redirect game ball roll along the longitudinal sidewall to roll along the end sidewall.

The aforementioned embodiment of the present invention yet further provides a soccer game table wherein said removable corner member includes an L-shaped extension adapted to receive at least one sidewall section.

Whereas, the present invention has been described in relation to the drawings attached hereto, it should be understood that other and further modifications, apart from those shown or suggested herein, may be made within the spirit and scope of this invention.

What is claimed is:

1. A soccer game table comprising:

a game surface;

at least four sidewall sections surrounding said game surface;

a substantially right angled corner defined by the intersection of two of said sidewall sections; and a removable corner ember having a curved face, said removable corner member being adapted to convert said substantially right-angled corner to a rounded corner by locating said curved face proximate said game surface, said removable corner member secured to said game table with a mounting portion engaging an outside of one of said sidewall sections.

2. The soccer gain table of claim 1 wherein said curved face has a circular radius of curvature.

3. The soccer gain table of Claim 1 wherein said curved face has a parabolic radius of curvature.

4. The soccer gain table of claim 1 wherein said curved face has a hyperbolic radius of curvature.

5. The soccer gain table of Claim 1 wherein said curved face is curved in three dimensions.

6. The soccer game table of claim 5 wherein said curved face includes a portion having a substantially spherical radius of curvature.

7. The soccer game table of claim 1 wherein said corner member includes an inclined foot.

8. The soccer game table of claim 1 further comprising a game ball adapted to roll on the game surface, wherein aid sidewall sections include a longitudinal sidewall section and an end sidewall section, and wherein said curved face has a radius of curvature adapted to redirect game ball roll along the longitudinal sidewall to roll along the end sidewall.

9. The soccer game table of claim 1 wherein said removable corner member includes an L-shaped extension adapted to receive at least one sidewall section.

10. The soccer game table according to claim 1 wherein:

said is slidably removable from said sidewall sections.

11. The soccer game Table according to claim 1 wherein:

said corner member is adjustable to fit on different sized tables.

12. A soccer game table comprising:

a game surface;

at least four sidewall sections surrounding said game surface, wherein an intersection of two of said sidewall sections define a corner; and a curved member located in said corner, said curved member slidably removable from said sidewall sections, said curved member having an interior curved face for locating proximate said game surface and having a mounting portion for locating externally of said sidewall sections; and wherein said curved member is slidably removable from said sidewall sections.

13. A soccer game table comprising a game surface;

at least four sidewall sections surrounding said game surface, wherein an intersection of two of said sidewall sections define a corner; and a curved member located in said corner, said curve member slidably removable from said sidewall section, said curved member having an interior curved face for locating proximate said game surface and having mounting portion for locating externally of said side-wall sections; and wherein said curved member is adjustable to fit on different sized tables.

* * * * *